US012012190B2

(12) United States Patent
Caldwell et al.

(10) Patent No.: US 12,012,190 B2
(45) Date of Patent: Jun. 18, 2024

(54) FLANGE FOR PRESSURE VESSEL WITH UNDERCUT FILLET

(71) Applicant: The United States of America, as represented by the Secretary of the Navy, San Diego, CA (US)

(72) Inventors: Jesse T. Caldwell, Alpine, CA (US); Brandon J. Wiedemeier, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 478 days.

(21) Appl. No.: 17/411,259

(22) Filed: Aug. 25, 2021

(65) Prior Publication Data

US 2023/0060597 A1 Mar. 2, 2023

(51) Int. Cl.
*B63G 8/04* (2006.01)
*B63G 8/00* (2006.01)

(52) U.S. Cl.
CPC ..... *B63G 8/04* (2013.01); *B63G 8/001* (2013.01); *B63G 2008/002* (2013.01)

(58) Field of Classification Search
CPC .... B63G 8/04; B63G 8/001; B63G 2008/002; B63B 3/13; F17C 2223/036
See application file for complete search history.

(56) References Cited

FOREIGN PATENT DOCUMENTS

JP H1113993 A * 1/1999

OTHER PUBLICATIONS

Sonmez F. O. "Optimal shape design of shoulder fillets for flat and round bars under various loadings." Proceedings of the Institution of Mechanical Engineers, Part C: Journal of Mechanical Engineering Science. 2009;223(8):1741-54.

* cited by examiner

*Primary Examiner* — Andrew Polay
(74) *Attorney, Agent, or Firm* — Naval Information Warfare Center, Pacific; Kyle Eppele; Evan Hastings

(57) ABSTRACT

A flange for a pressure vessel includes a rim, a sealing seat, and an undercut fillet. The rim has an annular surface for abutting an annular end of a cylindrical wall of the pressure vessel. The sealing seat has a cylindrical surface for abutting an inner surface of the cylindrical wall of the pressure vessel nearby the annular end. The undercut fillet is disposed between the rim and the sealing seat. A concave surface of the undercut fillet extends the annular surface of the rim radially inward and then curves back outward to intersect the cylindrical surface of the sealing seat. The undercut fillet of the flange helps distribute stress produced from a pressure differential between the inside and outside of the pressure vessel.

13 Claims, 2 Drawing Sheets

| |
|---|
| $L \approx 0.040 \times R$ |
| $X \approx 0.130 \times L$ |
| $R1 \approx 0.446 \times L$ |
| $Y \approx 0.054 \times L$ |
| $R2 \approx 0.876 \times L$ |
| $R3 \approx 0.200 \times L$ |
| $R4 \approx 0.260 \times L$ |
| $Z \approx 0.244 \times L$ |

FLANGE FOR PRESSURE VESSEL WITH UNDERCUT FILLET

FEDERALLY-SPONSORED RESEARCH AND DEVELOPMENT

The United States Government has ownership rights in this invention. Licensing and technical inquiries may be directed to the Office of Research and Technical Applications, Naval Information Warfare Center Pacific, Code 72120, San Diego, CA, 92152; voice (619) 553-5118; ssc_pac_t2@navy.mil. Reference Navy Case Number 109015.

BACKGROUND OF THE INVENTION

A pressure vessel must withstand the stress of a pressure differential between the interior and exterior of the pressure vessel. Exotic materials can increase the achievable pressure differential, but with increased manufacturing cost.

SUMMARY

A flange for a pressure vessel includes a rim, a sealing seat, and an undercut fillet. The rim has an annular surface for abutting an annular end of a cylindrical wall of the pressure vessel. The sealing seat has a cylindrical surface for abutting an inner surface of the cylindrical wall of the pressure vessel nearby the annular end. The undercut fillet is disposed between the rim and the sealing seat. A concave surface of the undercut fillet extends the annular surface of the rim radially inward and then curves back outward to intersect the cylindrical surface of the sealing seat. The undercut fillet of the flange helps distribute stress produced from a pressure differential between the inside and outside of the pressure vessel.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

Figure 1:
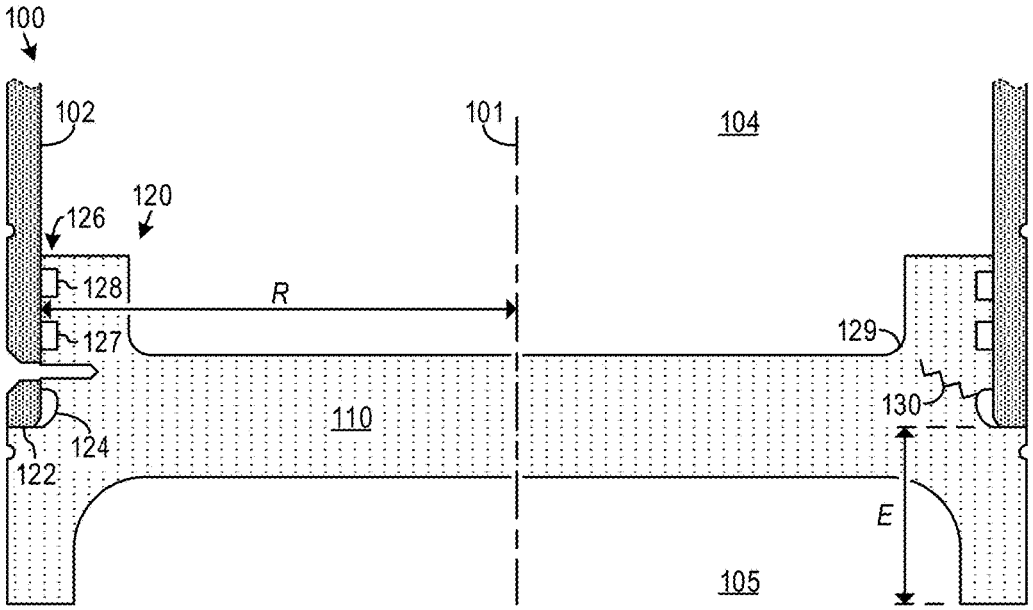
FIG. 1 is a cross-sectional diagram of a portion of a pressure vessel with an endcap, which includes a flange in accordance with embodiments of the invention.

The disclosed systems and methods below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

Embodiments of the invention provide a geometric solution supporting a flat endcap for a pressure vessel, with the flat endcap enabling attachment of mating components with reduced overall length of the system incorporating the pressure vessel, such as an unmanned underwater vehicle (UUV). Using ordinary materials, such as aluminum, the geometric solution achieves a pressure differential in a compact pressure vessel on par with existing solutions, which use expensive exotic materials and/or excessively large components. The geometric solution enables implementing an UUV at restrained cost within typical limits imposed on the length, diameter, and weight of the UUV.

High strength metals and non-metal composites have been typically used for underwater pressure vessels, such as boat hulls, buoys, and underwater sensor housings. Regardless of the material chosen, the material must withstand stress from the pressure differential between the inside and outside of the pressure vessel, must withstand corrosion and similar effects of the seawater environment, and should have reasonable cost and time to design and manufacture. Especially vulnerable in underwater pressure vessels are connecting flanges maintaining a pressure differential. Embodiment of the invention provide a solution using ordinary materials and sealing techniques for such flanges, and also provide interoperability with other system components while limiting cost and time to design and manufacture.

A typical underwater pressure vessel includes a cylindrical housing and endcaps covering the ends of the cylindrical housing. The pressure differential across the endcap tends to push the endcap inward. This effect is resisted by the inherent rigidity of the endcap material. For geometries with a flat endcap, it is believed that this rigidity is comprised partly from the geometric shape of the flat disc portion of the endcap as well as partly from the annular ring portion that typically houses the O-rings that seal the joint between the cylindrical housing and the endcap. As the pressure differential increases, disc portion bows inward. The inward movement of the disc is resisted by a torsional restoring moment in the annular ring portion. A stress concentration forms at the intersection between the bore of the annular ring and the bearing surface of the disc. Elimination of this stress concentration is usually accomplished by increasing the thickness of the disc portion of the flat endcap; however, the undercut surface of embodiments of the invention reduces this stress without such increased thickness by distributing this stress evenly over the undercut surface.

The inventors have discovered two key feature that allow a flange of a pressure vessel to efficiently withstand the pressure differential at extreme depths, while achieving a manufacturing cost lower than existing solutions. Namely, the geometric design of the flange undercut distributes stresses to limit the maximum stress concentration that typically appears at the intersection of the bore and bearing surfaces, while simultaneously minimizing size and weight of the flange. Second, the geometric solution is similar to the design of existing flanges manufactured for shallower depth. Because of these key features, manufacturing cost is on par with existing simple designs, but pressure vessels with the disclosed flange can go deeper into the seawater environment.

FIG. 1 is a cross-sectional diagram of a portion of a pressure vessel 100 with an endcap 110, which includes a flange 120 in accordance with embodiments of the invention. The pressure vessel 100 includes two components shown, the endcap 110 and a cylindrical wall 102. The endcap 110 maintains an internal pressure inside chamber 104 of the pressure vessel 100 lower than an external pressure outside the pressure vessel 100. For example, the pressure inside and outside the pressure vessel 100 is initially one atmosphere at sea level, but when the pressure vessel 100 is submerged in seawater, the outside pressure increases with depth, but the internal pressure inside chamber 104 is maintained at substantially one atmosphere.

The flange 120 for the pressure vessel 100 includes a rim 122, an undercut fillet 124, and a sealing seat 126. The rim 122 has an annular surface for abutting an annular end of a cylindrical wall 102 of the pressure vessel 100. The sealing seat 126 has a cylindrical surface for abutting an inner surface of the cylindrical wall 102 of the pressure vessel 100 nearby the annular end of a cylindrical wall 102. The undercut fillet 124 is disposed between the rim 122 and the sealing seat 126. A concave surface of the undercut fillet 124 extends the annular surface of the rim 122 radially inward and then curves back outward to intersect the cylindrical surface of the sealing seat 126.

In the related art, a hemispherical endcap evenly distributes stress produced when an external pressure is higher than an internal pressure within a pressure vessel. However, such a hemispherical endcap has an axial length equaling a radius of a cylindrical wall of the pressure vessel.

In contrast, embodiments of the invention provide an axial extension E of the endcap 110 along a symmetry axis 101 of less than half of a radius R of the cylindrical surface of the sealing seat 126 from the symmetry axis 101, which is an axis of rotational symmetry of both the cylindrical surface of the sealing seat 126 and the annular surface of the rim 122. For example, an unmanned underwater vehicle (UUV) has first chamber 104 and a second chamber 105, with the first chamber 104 maintained at an internal pressure inside the pressure vessel 100 lower than an external pressure outside the pressure vessel 100, but the second chamber 105 is allowed to equalize to the external pressure. The flange 120 of the endcap 110 of embodiments of the invention enables a more compact UUV than the hemispherical endcap of the related art because the axial extension E of the endcap 110 is significantly less than the corresponding axial length of the hemispherical endcap.

The sealing seat 126 of the flange 120 includes one or more grooves 127 and 128 in the cylindrical surface of the sealing seat 126. Each of the grooves 127 and 128 receives an O-ring (see FIG. 3) for forming a double bore seal between the cylindrical surface of the sealing seat 126 and the inner surface of the cylindrical wall 102 of the pressure vessel 100. Because of this seal formed by the O-rings, along the axial length of the sealing seat 126 the local pressure decreases stepwise from the higher external pressure outside the pressure vessel 100 to the lower internal pressure inside the chamber 104 of the pressure vessel 100.

In particular, the pressure inside the void of the undercut fillet 124 tends to equalize to the external pressure. Because of this, any pressure differential between the higher external pressure and the lower internal pressure generates surface stress that stretches the concave surface of the undercut fillet 124. This pressure differential also presses the entire endcap 110 upwards in FIG. 1 against the cylindrical wall 102 at the rim 122, causing a torsional moment around the undercut fillet 124 that further stretches the concave surface of the undercut fillet 124 and also compresses the nearby concave surface 129 of the flange 120. This stretching and compressing tends to form a crack 130 originating at the concave surface of the undercut fillet 124 and propagating toward the nearby concave surface 129 of the flange 120. Such a crack 130 could cause failure of the endcap 110 and rupture of the pressure vessel 100. In addition, this stretching and compressing tends to plastically deform the flange 120, tending to cause necking in areas of stress concentration. Such necking could also cause failure of the endcap 110 and rupture of the pressure vessel 100. Thus, the stress on flange 120 needs to be maintained below the yield strength of the selected material with a reasonable safety margin.

However, embodiments of the flange 120 distribute this stress around the undercut fillet 124 to limit a maximum concentration of this stress produced when an external pressure outside the pressure vessel 100 is higher than an internal pressure inside the pressure vessel 100. This distributed stress inhibits formation of the crack 130 and necking from plastic deformation because nowhere does the surface stress exceed the yield strength of the selected material with an appropriate safety margin.

Figure 2:
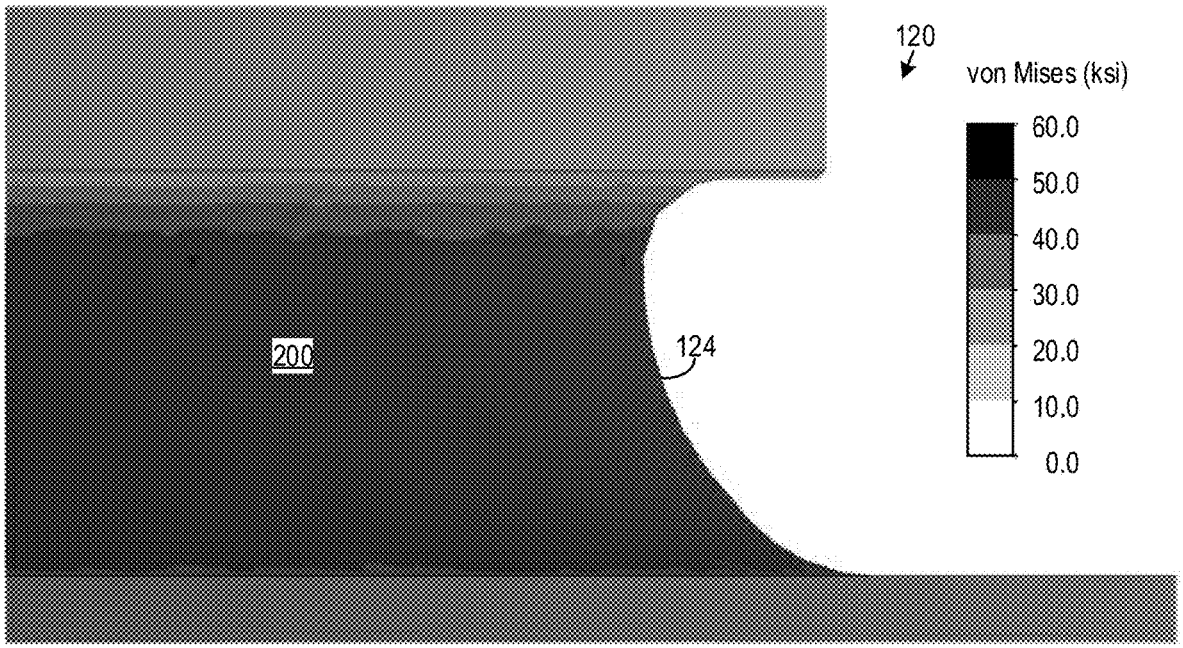
FIG. 2 is a side view of a flange with an undercut fillet showing surface stress in accordance with an embodiment of the invention.

FIG. 2 is a side view of a flange 120 with an undercut fillet 124 showing surface stress 200 in accordance with an embodiment of the invention. The surface stress 200 was computed from a finite element analysis of the flange 120 with loads applied for a flange 120 composed of aluminum.

The concave surface of the undercut fillet 124 is shaped to distribute the surface stress 200 in a distribution around the concave surface and to limit a maximum concentration of the surface stress 200 in the distribution, the surface stress 200 produced when an external pressure outside the pressure vessel is higher than an internal pressure inside the pressure vessel. As shown in FIG. 2, the surface stress 200 is nearly constant across a majority of the concave surface of the undercut fillet 124, without the lateral lines of increased stress typically seen in existing flanges, such that the maximum concentration of the surface stress 200 equals this constant stress. The distributed surface stress 200 limited at a maximum to this constant stress inhibits formation of the crack 130 and necking from plastic deformation. A pressure vessel without an undercut fillet 124 would fail at a much lower pressure differential than embodiments of the invention having the undercut fillet 124 of flange 120.

It will be appreciated that the surface stress 200 depends upon the material and size of the flange 120 and upon the applied differential pressure; however, with size scaling as discussed below and for various materials and applied differential pressures, the surface stress remains evenly distributed as shown in the embodiment of FIG. 2.

Figure 3:
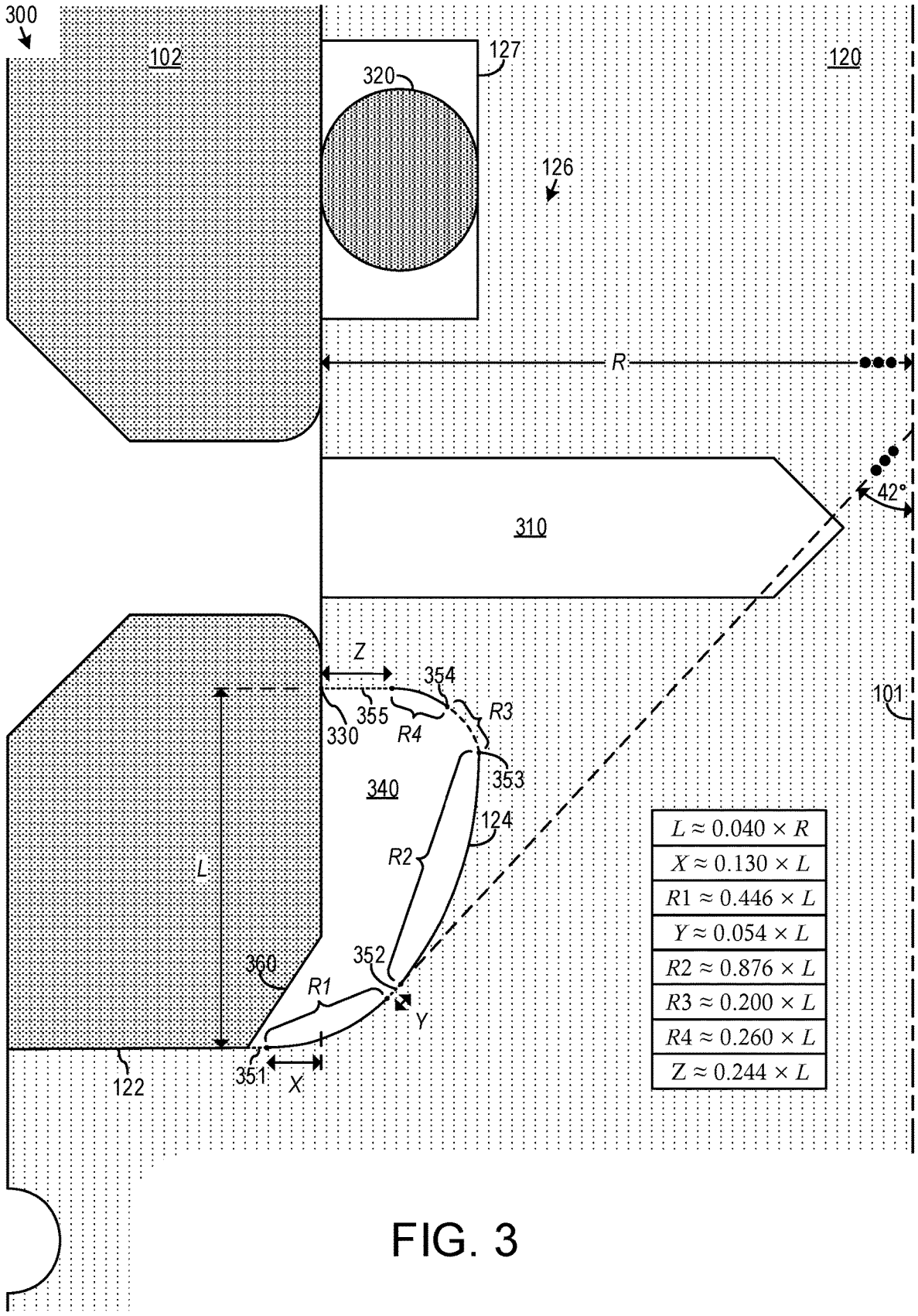
FIG. 3 is a cross-sectional diagram of showing details of a flange in accordance with an embodiment of the invention.

FIG. 3 is a cross-sectional diagram 300 of showing details of a flange 120 in accordance with an embodiment of the invention. The pressure vessel includes the flange 120 and the cylindrical wall 102. The flange 120 includes a rim 122, an undercut fillet 124, and a sealing seat 126. The rim 122 has an annular surface for abutting an annular end of a cylindrical wall 102 of the pressure vessel. The sealing seat 126 has a cylindrical surface for abutting an inner surface of the cylindrical wall 102 of the pressure vessel nearby the annular end of a cylindrical wall 102. The undercut fillet 124 is disposed between the rim 122 and the sealing seat 126. A concave surface of the undercut fillet 124 extends the annular surface of the rim 122 radially inward and then curves back outward to intersect the cylindrical surface of the sealing seat 126.

The sealing seat 126 further includes threaded recesses including threaded recess 310 in the cylindrical surface of the sealing seat 126 between the groove 127 with O-ring 320 and an intersection 330 at which the concave surface of the undercut fillet 124 intersects the cylindrical surface of the sealing seat 126. Each threaded recess 310 receives a threaded fastener (not shown) for fastening the cylindrical wall 102 of the pressure vessel to the flange 120.

The concave surface of the undercut fillet 124 is shaped to form a void 340 between the concave surface and the inner surface of the cylindrical wall 102 of the pressure vessel when the annular surface of the rim 122 abuts the annular end of the cylindrical wall 102 of the pressure vessel and the cylindrical surface of the sealing seat 126 abuts the inner surface of the cylindrical wall 102 of the pressure vessel. The concave surface of the undercut fillet 124 is rotationally symmetric about a symmetry axis 101, and the concave surface of the undercut fillet 124 has a concave contour in a cross sectional plane encompassing the symmetry axis 101.

The concave contour of the undercut fillet 124 includes a sequence of arc segments. In a preferred embodiment of FIG. 3, the sequence of arc segments includes four arc segments, and each of the arc segments has a respective radius R1, R2, R3, and R4 selected to distribute a stress in a distribution along the concave contour and to limit a maximum concentration of the stress in the distribution, the stress produced when an external pressure outside the pressure vessel is higher than an internal pressure inside the pressure vessel.

The sequence of arc segments includes fewer than four arc segments or more than four arc segments in other embodiments. In one embodiment, the sequence of arc segments includes a first arc segment and a second arc segment. The first arc segment with radius R1 adjoins an inner edge of the annular surface of the rim 122 at a first continuous slope 351 and the second arc segment with radius R2 adjoins the first arc segment at a second continuous slope 352. The sequence of arc segments is optimized to minimize the maximum concentration of the stress in a distribution around the undercut fillet 124, so that the respective radius R1 of the first arc segment equals 0.446×L and the respective radius R2 of the second arc segment equals 0.876×L, where L equals 0.040×R and is an axial length of the concave contour of the undercut fillet 124, and R is an outer radius from the symmetry axis 101 of the cylindrical surface of the sealing seat 126 and also an inner radius of the inner surface of the cylindrical wall 102 of the pressure vessel. The second continuous slope 352 between the first and second arc segments has an angle of 42° from the symmetry axis 101 in the cross sectional plane. Thus, the various dimensions of the undercut fillet 124 of the flange 120 scale linearly with the radius R the cylindrical surface of the sealing seat 126.

The maximum stress concentration of the undercut fillet 124 is within the segment with radius R2 as suggested with the surface stress 200 shown in FIG. 2. However, the stress concentration is nearly constant across the segment with radius R2 and this segment is the longest segment. Thus, the maximum of the distributed stress concentration is spread over the large area of the segment with radius R2. The segment with radius R1 further distributes surface stress because the majority of this segment has a stress concentration approaching the maximum stress concentration of the segment with radius R2. Because the maximum stress concentration is spread over a large area, the undercut fillet 124 supports larger applied loads.

Returning to a preferred embodiment of FIG. 3 with four arc segments with radii R1, R2, R3, and R4, the first arc segment with radius R1 adjoins an inner edge of the annular surface of the rim 122 at an offset X radially outward from the cylindrical surface of the sealing seat 126 and at a first continuous slope 351 substantially perpendicular to the symmetry axis 101 in the cross sectional plane. The first arc segment has the offset X≈0.130×L and the radius R1≈0.446×L, where L≈0.040×R is an axial length of the concave contour of the undercut fillet 124 and R is an outer radius from the symmetry axis 101 of the cylindrical surface of the sealing seat 126.

The offset X enables the undercut fillet 124 to distribute stress over a longer distance and hence further limits a maximum concentration of the stress in the distribution around the undercut fillet 124. To accommodate the offset X, the cylindrical wall 102 has a beveled edge 360 so that an inner radius of the annular surface of the rim 122 from the symmetry axis 101 is greater than the outer radius R of the cylindrical surface of the sealing seat 126 from the symmetry axis 101.

In another embodiment, the offset Xis zero or negative, and the concave surface of the undercut fillet 124 is disposed inside an imaginary solid cylinder, which has a curved outside encompassing the cylindrical surface of the sealing seat 126 and a flat end within a plane encompassing the annular surface of the rim 122.

Returning to the preferred embodiment of FIG. 3 with four arc segments with radii R1, R2, R3, and R4, the second arc segment with radius R2 adjoins the first arc segment at a second continuous slope 352 having a length Y≈0.054×L and an angle approximately equal to 42° from the symmetry axis 101 in the cross sectional plane. The second arc segment has a radius R2≈0.876×L. The third arc segment with radius R3 adjoins the second arc segment at a third continuous slope 353 substantially parallel to the symmetry axis 101 in the cross sectional plane. Substantially parallel includes within ±20° of parallel, and substantially perpendicular includes within ±20° of perpendicular. Similarly, approximately equal, also given by symbol "≈" in the various equations, includes within ±20%. The third arc segment has a radius R3≈0.200×L. The fourth arc segment with radius R4 adjoins the third arc segment at a fourth continuous slope 354. The fourth arc segment has a radius R4≈0.260×L. A linear extension adjoins the fourth arc segment at a fifth continuous slope 355 substantially perpendicular to the symmetry axis 101 in the cross sectional plane. The linear extension with fifth continuous slope 355 intersects the cylindrical surface of the sealing seat 126 at the substantially perpendicular intersection 330 and has a length Z≈0.244×L.

The various equations describing a preferred embodiment of the undercut fillet 124 are summarized in the table below.

| R (scale factor) | Radius from the symmetry axis of cylindrical surface of sealing seat |
|---|---|
| L ≈ 0.040 × R | Axial length of concave contour of undercut fillet |
| X ≈ 0.130 × L | Radial offset of first arc segment from cylindrical surface of sealing seat |
| R1 ≈ 0.446 × L | Radius of first arc segment |
| Y ≈ 0.054 × L | Length of continuous slope between first and second arc segments |
| R2 ≈ 0.876 × L | Radius of second arc segment |
| R3 ≈ 0.200 × L | Radius of third arc segment |
| R4 ≈ 0.260 × L | Radius of fourth arc segment |
| Z ≈ 0.244 × L | Length of linear extension to cylindrical surface of sealing seat |

From the above description of the Flange for Pressure Vessel with Undercut Fillet, it is manifest that various techniques may be used for implementing the concepts of the flange without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that flange is not limited to the particular embodiments described herein, but is capable of many embodiments without departing from the scope of the claims.

We claim:

1. A flange for a pressure vessel comprising:

a rim with an annular surface for abutting an annular end of a cylindrical wall of the pressure vessel;

a sealing seat with a cylindrical surface for abutting an inner surface of the cylindrical wall of the pressure vessel nearby the annular end;

an undercut fillet between the rim and the sealing seat, wherein a concave surface of the undercut fillet extends the annular surface of the rim radially inward and then curves back outward to intersect the cylindrical surface of the sealing seat, wherein the concave contour includes a sequence of arc segments, with each of the arc segments having a respective radius selected to distribute a stress in a distribution along the concave contour and to limit a maximum concentration of the stress in the distribution, the stress produced when an external pressure outside the pressure vessel is higher than an internal pressure inside the pressure vessel; and wherein the sequence of arc segments includes a first arc segment and a second arc segment, the first arc segment adjoining an inner edge of the annular surface of the rim at a first continuous slope and the second arc segment adjoining the first arc segment at a second continuous slope.

2. The flange of claim 1, wherein the concave surface of the undercut fillet is shaped to form a void between the concave surface and the inner surface of the cylindrical wall of the pressure vessel when the annular surface of the rim abuts the annular end of the cylindrical wall of the pressure vessel and the cylindrical surface of the sealing seat abuts the inner surface of the cylindrical wall of the pressure vessel.

3. The flange of claim 1, wherein the concave surface of the undercut fillet is disposed inside an imaginary solid cylinder, which has a curved outside encompassing the cylindrical surface of the sealing seat and a flat end within a plane encompassing the annular surface of the rim.

4. The flange of claim 1, wherein the concave surface is shaped to distribute a stress in a distribution around the concave surface and to limit a maximum concentration of the stress in the distribution, the stress produced when an external pressure outside the pressure vessel is higher than an internal pressure inside the pressure vessel.

5. The flange of claim 1, wherein the concave surface of the undercut fillet is rotationally symmetric about a symmetry axis, and the concave surface of the undercut fillet has a concave contour in a cross-sectional plane encompassing the symmetry axis.

6. The flange of claim 5, wherein the concave contour is shaped to distribute a stress in a distribution along the concave contour and to limit a maximum concentration of the stress in the distribution, the stress produced when an external pressure outside the pressure vessel is higher than an internal pressure inside the pressure vessel.

7. The flange of claim 1, wherein the sequence of arc segments is optimized to minimize the maximum concentration of the stress in the distribution, so that the respective radius R1 of the first arc segment equals 0.446×L and the respective radius R2 of the second arc segment equals 0.876×L, where L equals 0.040×R and is an axial length of the concave contour of the undercut fillet, and R is an outer radius from the symmetry axis of the cylindrical surface of the sealing seat and an inner radius of the inner surface of the cylindrical wall of the pressure vessel, and so that the second continuous slope between the first and second arc segments has an angle of 42° from the symmetry axis in the cross-sectional plane.

8. A flange for a pressure vessel comprising:

a rim with an annular surface for abutting an annular end of a cylindrical wall of the pressure vessel;

a sealing seat with a cylindrical surface for abutting an inner surface of the cylindrical wall of the pressure vessel nearby the annular end;

an undercut fillet between the rim and the sealing seat, wherein a concave surface of the undercut fillet extends the annular surface of the rim radially inward and then curves back outward to intersect the cylindrical surface of the sealing seat wherein the concave contour includes a sequence of arc segments, with each of the arc segments having a respective radius selected to distribute a stress in a distribution along the concave contour and to limit a maximum concentration of the stress in the distribution, the stress produced when an external pressure outside the pressure vessel is higher than an internal pressure inside the pressure vessel; and wherein the sequence of arc segments includes a first, second, third, and fourth arc segment, the first arc segment adjoining an inner edge of the annular surface of the rim at an offset X radially outward from the cylindrical surface of the sealing seat and at a first continuous slope perpendicular to the symmetry axis in the cross-sectional plane, the first arc segment having the offset X≈0.130×L and a radius R1≈0.446×L, where L≈0.040×R is an axial length of the concave contour of the undercut fillet and R is an outer radius from the symmetry axis of the cylindrical surface of the sealing seat, the second arc segment adjoining the first arc segment at a second continuous slope having a length Y≈0.054×L and an angle of 42° from the symmetry axis in the cross-sectional plane, the second arc segment having a radius R2≈0.876×L, the third arc segment adjoining the second arc segment at a third continuous slope substantially parallel to the symmetry axis in the cross-sectional plane, the third arc segment having a radius R3≈0.200×L, and the fourth arc segment adjoining the third arc segment at a fourth continuous slope and a linear extension adjoining the fourth arc segment at a fifth continuous slope perpendicular to the symmetry axis in the cross-sectional plane, the fourth arc segment having a radius R4≈0.260×L, the linear extension perpendicularly intersecting the cylindrical surface of the sealing seat and having a length Z=0.244×L.

9. A flange for a pressure vessel comprising:

a rim with an annular surface for abutting an annular end of a cylindrical wall of the pressure vessel;

a sealing seat with a cylindrical surface for abutting an inner surface of the cylindrical wall of the pressure vessel nearby the annular end;

an undercut fillet between the rim and the sealing seat, wherein a concave surface of the undercut fillet extends the annular surface of the rim radially inward and then curves back outward to intersect the cylindrical surface of the sealing seat; and wherein the sealing seat includes one or more grooves in the cylindrical surface of the sealing seat, each of the grooves for receiving an O-ring for forming a seal between the cylindrical surface of the sealing seat and the inner surface of the cylindrical wall of the pressure vessel.

10. The flange of claim 9, wherein the sealing seat further includes a plurality of threaded recesses in the cylindrical surface of the sealing seat between the grooves and an intersection at which the concave surface of the undercut fillet intersects the cylindrical surface of the sealing seat, the threaded recesses for receiving a plurality of threaded fasteners for fastening the cylindrical wall of the pressure vessel to the flange.

11. The flange of claim 9, wherein an inner radius of the annular surface of the rim from a symmetry axis is greater than an outer radius of the cylindrical surface of the sealing seat from the symmetry axis, which is the symmetry axis of rotational symmetry of both the cylindrical surface of the sealing seat and the annular surface of the rim.

12. An endcap including the flange of claim 9, wherein the endcap is for maintaining an internal pressure inside the pressure vessel lower than an external pressure outside the pressure vessel, and an axial extension of the endcap along a symmetry axis is less than half of a radius of the cylindrical surface of the sealing seat from the symmetry axis, which is the symmetry axis of rotational symmetry of both the cylindrical surface of the sealing seat and the annular surface of the rim.

13. A pressure vessel including endcap of claim 12, wherein the pressure vessel includes:

the endcap including the flange, and the cylindrical wall, which has a beveled edge so that an inner radius of the annular surface of the rim from the symmetry axis is greater than an outer radius of the cylindrical surface of the sealing seat from the symmetry axis.

* * * * *